US005996506A

United States Patent [19]

Woytovich

[11] Patent Number: 5,996,506

[45] Date of Patent: Dec. 7, 1999

[54] PUBLIC REST ROOM SHELF

[76] Inventor: Justine Rose Woytovich, 351 Wayne St., Baden, Pa. 15005

[21] Appl. No.: 09/184,144

[22] Filed: Nov. 2, 1998

[51] Int. Cl.[6] ..... A47B 37/00

[52] U.S. Cl. ..... 108/42; 211/113

[58] Field of Search ..... 108/44, 47, 46, 108/50.16, 149; 4/605, 551, 579; 211/113, 119, 117; 298/317

[56] References Cited

U.S. PATENT DOCUMENTS

| | | | |
|---|---|---|---|
| 727,423 | 5/1903 | Oppenheimer . | |
| 904,355 | 11/1908 | O'Connor | 108/47 |
| 1,571,753 | 2/1926 | Christian | 108/47 |
| 4,059,248 | 11/1977 | Kuntz . | |
| 4,149,693 | 4/1979 | LoNigro . | |
| 4,535,962 | 8/1985 | Chan et al. . | |
| 5,427,344 | 6/1995 | Beauchemin . | |
| 5,505,318 | 4/1996 | Goff . | |

FOREIGN PATENT DOCUMENTS

| | | | |
|---|---|---|---|
| 13998 | 7/1908 | United Kingdom | 108/30 |
| 193998 | 3/1923 | United Kingdom | 108/44 |

*Primary Examiner*—Peter M. Cuomo
*Assistant Examiner*—Gerald A. Anderson
*Attorney, Agent, or Firm*—Aileen Champion Addessi

[57] ABSTRACT

A rest room shelf for use in a public rest room includes a base for storage of a person's personal items and adjustable brackets which fit over a rest room stall wall for supporting the base. The brackets include first and second bracket members which when slidably secured together form a U-shape. The U-shaped bracket fits on top of the stall wall in the rest room and the U-shaped portion of the bracket may be widened or narrowed depending on the width of the stall wall for providing a secure fit of the bracket onto the stall wall. An alternative bracket may be used for installing the rest room shelf directly onto a wall in the rest room. At least one hook is attached to the base for providing additional storage space for a person using the shelf.

10 Claims, 3 Drawing Sheets

PUBLIC REST ROOM SHELF

BACKGROUND OF THE INVENTION

The invention relates to shelves for storage of items and, more particularly, to a shelf which can be hung in a public rest room.

In public rest rooms, often there are no shelves or hooks for storage of a person's personal items, such as shopping bags, coats, umbrellas, diaper bags, etc. A person must put these items on the floor, which is usually dirty and also makes the items accessible for someone to steal.

There are several kinds of shelves and brackets available for different purposes. One such device is disclosed in U.S. Pat. No. 4,059,248 issued Nov. 22, 1977 to Kuntz and entitled "Shelf Support Bracket for Mounting on Railings and the like". The shelf bracket includes a U-shaped mounting bracket which may be mounted on a railing. A thumbscrew is installed in one of the legs of the bracket for engaging the railing support and enabling leveling of the shelf. However, the U-shaped bracket does not have means for adjusting the size of the U-shaped bracket for accommodating various sized railings or the like.

Another type of shelf is disclosed in U.S. Pat. No. 5,505,318 issued Apr. 9, 1996 to Goff and entitled "Collapsible Rack". The collapsible rack includes shelves which are mounted by brackets directly to a wall. However, the shelves are attached to support rods which extend vertically along the wall, and the front edge of the shelf is not supported by a bracket.

Therefore, what is needed is an apparatus for storing items in a public rest room which utilizes brackets which may be adjusted for positioning the brackets over various sized rest room stall walls.

SUMMARY OF THE INVENTION

A rest room shelf positioned within a rest room stall includes a base having a first and second side edge and a surface positioned therebetween. The surface is formed of a grid for a person using a rest room to position items on the surface. At least one hook is attached to the base and hangs downwardly therefrom for enabling a person to hang items from the hook. A pair of U-shaped brackets are attached to each of the first and second side edges of the base. Each of the U-shaped brackets has a first bracket member and a second bracket member slidably attached together. Each of the first and second bracket members has a first arm which extends vertically along a rest room stall wall. The first arm of the first bracket member is positioned on an opposite side of the rest room stall wall as the first arm of the second bracket member. Each of the first and second bracket members has a second arm which extends substantially perpendicular to the first arm and has a slot therein. The second arm of the first bracket overlaps the second arm of the second bracket for forming the U-shaped brackets. A fastener is positioned within each of the slots of the second arms of the first and second bracket members for adjustably attaching the first and second bracket members together. An adjustment member is adjustably attached to at least one of the first arms of the U-shaped brackets and contacts the rest room stall wall for providing support to the rest room shelf.

The fastener of the rest room shelf may include a screw and a nut with a locking washer. The screw is inserted through the slots of the first and second brackets for adjustably securing the U-shaped bracket to the rest room stall wall. The adjustment member may include a nut attached to the first arm of the U-shaped bracket and a wing nut disposed through a hole of the first arm, threadedly attached to the nut, and having a cushioned tip contacting the rest room stall wall.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

Figure 1:
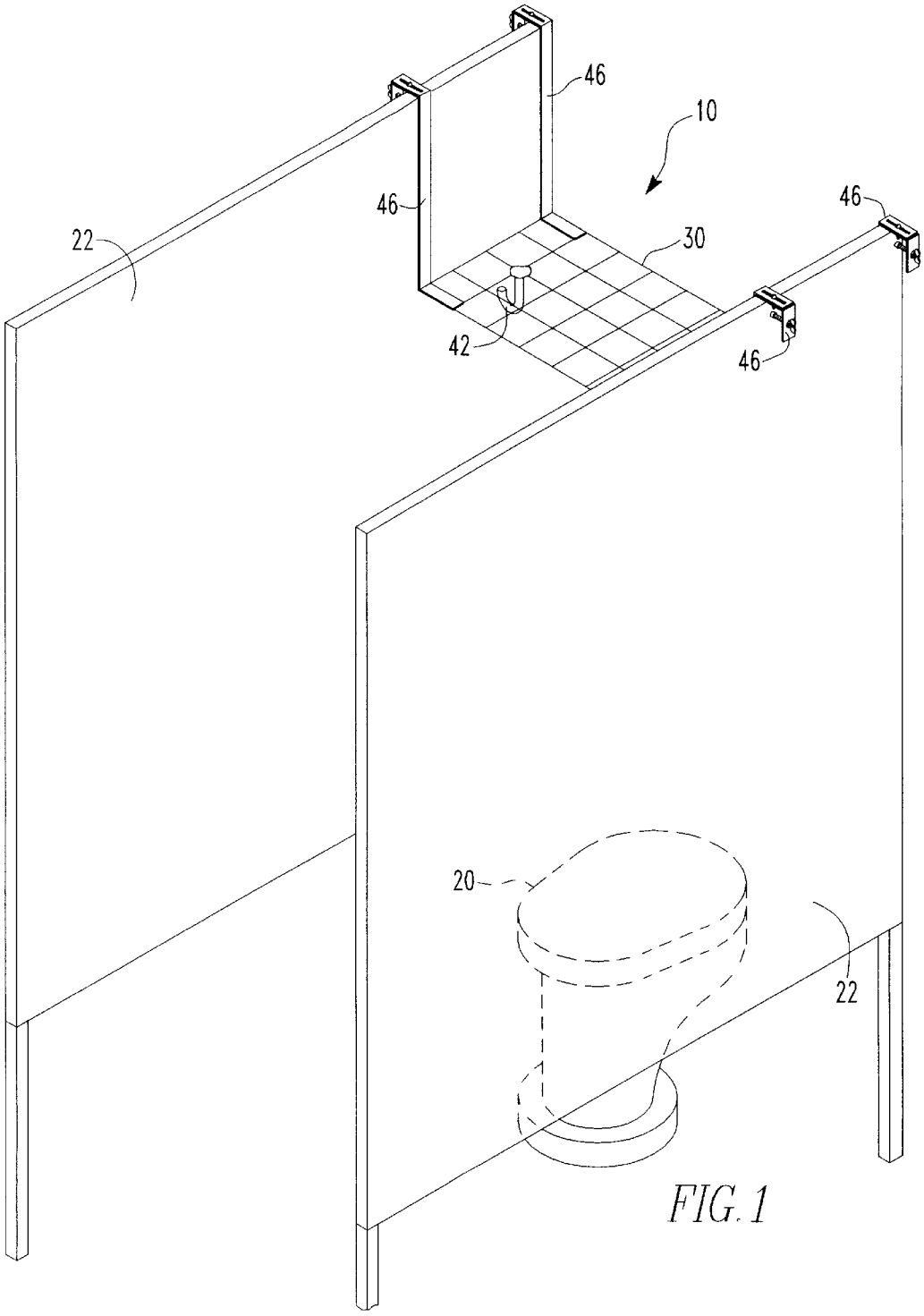
FIG. 1 is an isometric view of a bathroom stall with a rest room shelf attached.
Figure 2:
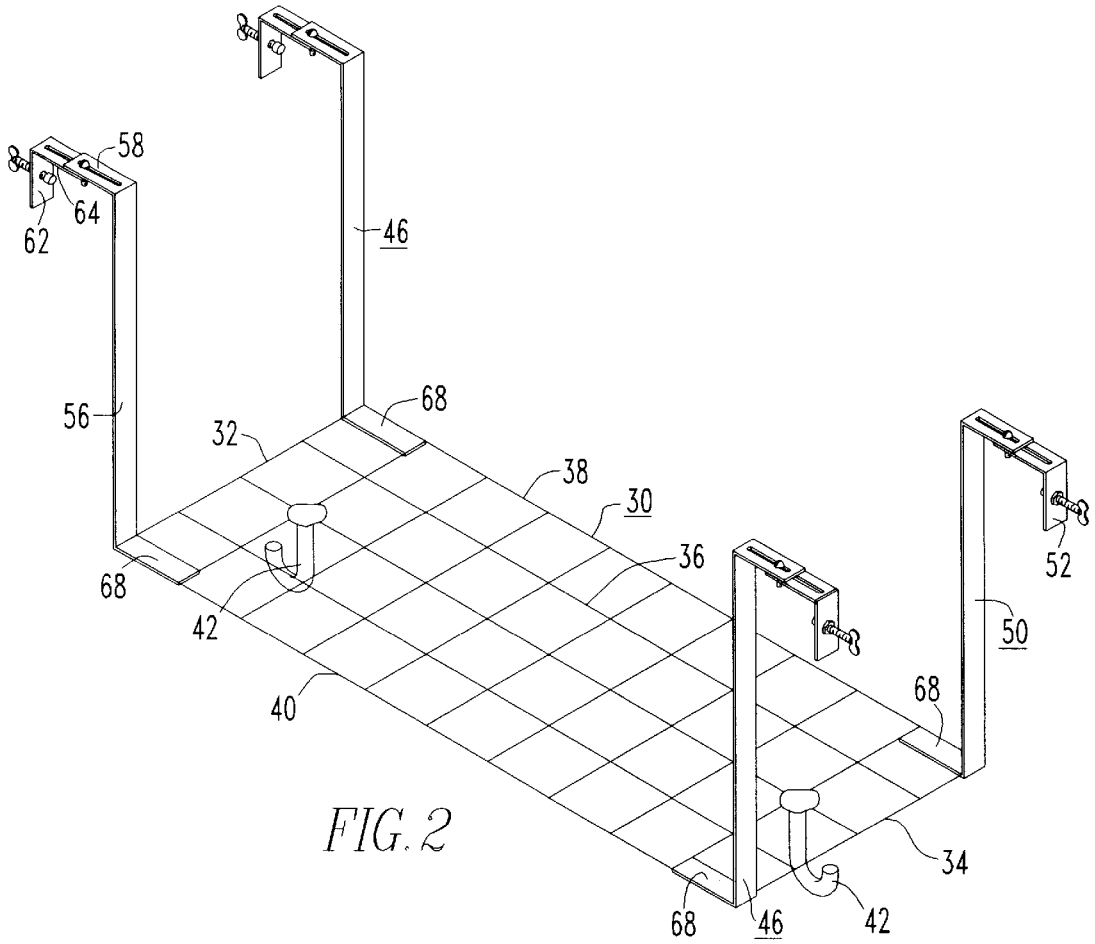
FIG. 2 is an enlarged view of the rest room shelf.
Figure 3:
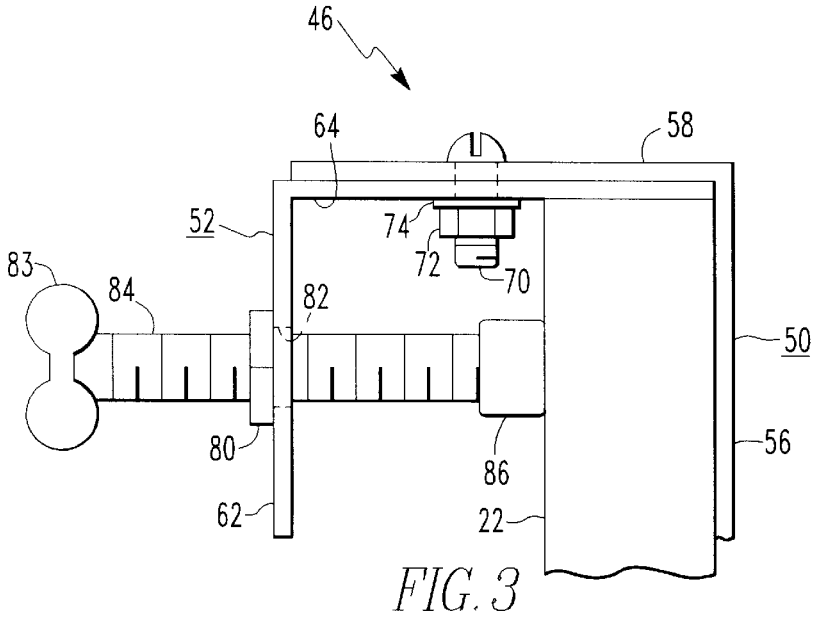
FIG. 3 is a cross-sectional view of a bracket of the rest room shelf positioned on a stall wall.
Figure 4:
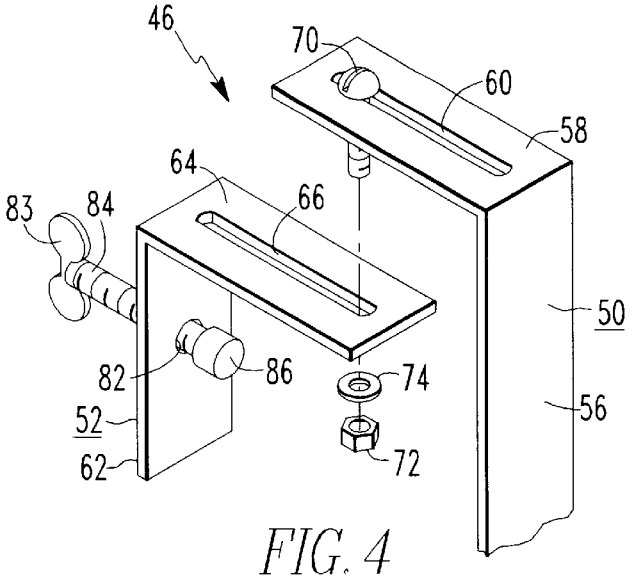
FIG. 4 is an exploded top view of the bracket having slots.
Figure 5:
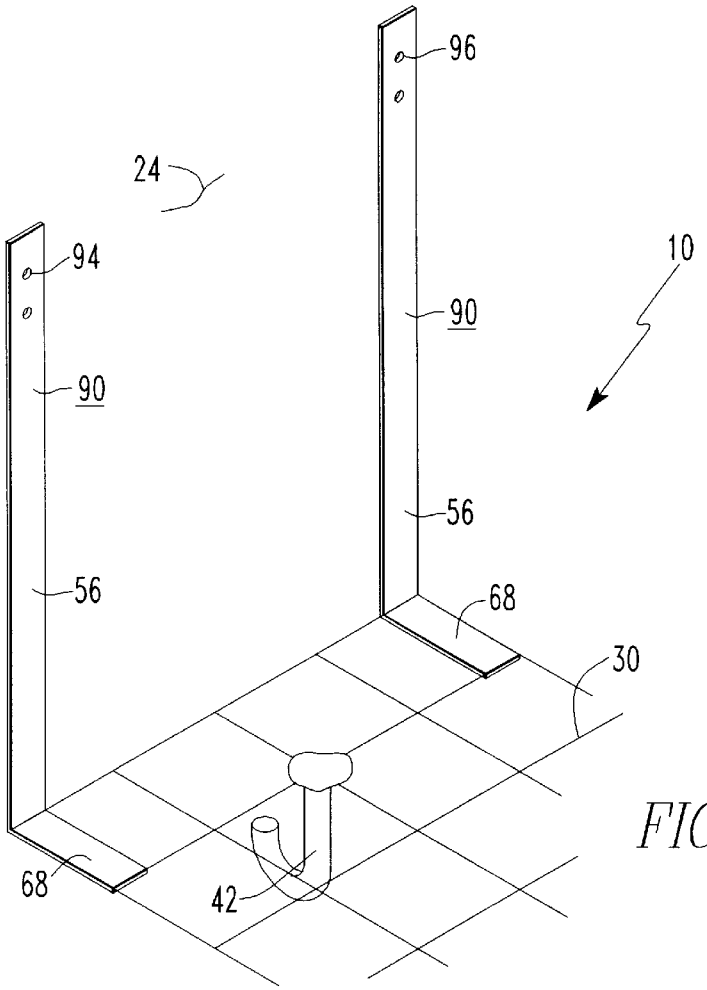
FIG. 5 is an alternative embodiment of the rest room shelf having one bracket attached to a rest room wall.

Referring to FIGS. 1 and 5, a shelf 10 is positioned behind and above a toilet 20 in a public rest room. The public rest room has stall walls 22 with the toilet 20 disposed therebetween, or alternatively, a stall wall 22 and a rest room wall 24 with the toilet 20 disposed therebetween.

Referring to FIGS. 1–4, the shelf 10 includes a base 30 which extends substantially parallel with the ground or floor of the rest room for providing an area for storing various items. The base 30 has a first side edge 32, a second side edge 34, and a surface 36 positioned therebetween. The base 30 has a rear edge 38 which is positioned adjacent to a wall in the rest room and a front edge 40 which extends horizontally outward from and substantially perpendicular to the rest room wall. The base 30 may be formed of metal, plastic, wood, a composite of various materials, or the like, and may be a grid, solid, mesh or any other suitable type of material.

The base 30 further includes at least one hook 42 attached to an underside of the surface 36 and extending downwardly for enabling a person to hang items, such as an umbrella, purse, shopping bag, diaper bag, or the like.

The shelf 10 includes a pair of brackets 46 attached to each of the first and second side edges 32 and 34 of the base 30. The brackets 46 extend substantially perpendicular to the base 30 and vertically along the stall wall 22 in the rest room. Each of the brackets 46 is U-shaped and fits over the top of the stall wall 22 in the rest room.

Each of the brackets 46 includes a first bracket member 50 and a second bracket member 52 for making the U-shaped portion of the bracket 46 adjustable for accommodating various widths of stalls and stall walls 22. The first bracket member 50 includes a first arm 56 which is attached to the base 30 and a second arm 58, which is positioned substantially perpendicular to the first arm 56. The second arm 58 has a slot 60.

The second bracket member 52 includes a first arm 62 which is shorter than the first arm 56 and extends along an opposite side of the stall wall 22. The second bracket member 52 also includes a second arm 64, which is positioned substantially perpendicular to the first arm 62 and has a slot 66. The slot 66 of the second bracket member 52 is aligned with the slot 60 of the first bracket member 50.

As an alternative to the use of adjustably securing together the first and second bracket members 50 and 52, two first bracket members 50 may be adjustably secured together for forming the U-shaped bracket 46. For this alternative example, each of the two first bracket members 50 are attached to separate bases 30 which are positioned in adjacent stalls.

The first bracket member 50 may be integrally formed with or attached to an extension 68 which is attached to the base 30, such as by mechanical means, welding, adhesively, or the like. Any other type of adjustable bracket may be used to support the base 30 within the rest room stall.

A fastener is disposed through the slots 60 and 66 for slidably attaching together the first and second bracket members 50 and 52. As one example, the fastener may be a screw 70 and a nut 72 with a locking washer 74. Any other type of fastener may be used for adjustably securing together the brackets 46.

An adjustment member or spacer is adjustably attached to the bracket 46 for providing support and stability to the shelf 10. The adjustment member may be positioned on either side of the stall wall 22. The adjustment member is used to accommodate the various widths of stalls and stall walls and to secure the shelf 10 to the walls. The adjustment member can also be used to level the base 30. As one example, the adjustment member may include a nut 80 attached to the second bracket member 52 and aligned with a hole 82 disposed through the second bracket members 52. The adjustment member further includes a wing nut 83 integrally formed with or attached to a threaded rod extension 84, which is threadedly disposed through the hole 82 and through the nut 80. The threaded rod extension 84 of the wing nut 83 has a cushioned tip 86, formed of vinyl, rubber, plastic, or the like, which contacts the stall wall 22 for providing a firm, stable positioning of the brackets 46 on the stall wall 22. Any other type of adjustment member or spacer may be used for supporting the brackets 46 of the shelf 10.

For the various embodiments of this invention, the same reference characters will be used to designate like parts. In addition, like functions and like interactions of the parts among the various embodiments of this invention will not be repeated for each embodiment.

Referring to FIG. 5 and using the same reference characters to define like parts, an alternative embodiment of the bracket 46 as illustrated in FIGS. 1–4 may be a pair of brackets 90 having only the first arm 56 of the first bracket member 50. The first arm 56 is attached to the base 30 and has at least one hole 94 for insertion of a fastener or securement member 96, such as a screw or the like, to secure the bracket 90 directly to a wall of the public rest room. This type of bracket 90 would be used at each end of the row of toilets, where there may not be a stall wall 22 on both sides of the toilet 20.

To install the rest room shelf 10, the U-shaped brackets 46 are slid over the rest room stall wall 22 and rest on top of the stall wall 22. The first and second bracket members 50 and 52 can be slid closer together or farther apart to accommodate the size of the stall and the stall wall 22. After the U-shaped bracket 46 is adjusted, the fastener is tightened to secure together the first and second bracket members 50 and 52. The adjustment member is adjusted until the cushioned tip 86 contacts the stall wall 22 and the first arms 56 and 62 are positioned substantially perpendicular to the floor of the rest room and parallel to the stall wall 22 for positioning the base 30 in a stable position which is substantially parallel to the floor of the rest room.

To install the brackets 90, the brackets 90 are positioned against the rest room wall 24. The securement member 96 is disposed through hole 94 in the bracket 90 and is positioned in the rest room wall 24 for securing the brackets 90 to the wall 24.

An advantage of the public rest room shelf 10 is that the shelf 10 can be easily installed on existing rest room stall walls. The shelf 10 does not need to be fixedly attached to the stall walls and can be installed without making any holes in the existing stall wall.

Another advantage is that an alternative bracket is provided for installing the shelf 10 directly to a rest room wall, in the event that the rest room does not have stall walls, such as rest rooms built of cement block, or that the stall walls alternate with the rest room wall, such as stalls positioned at the end of a row of toilets.

Another advantage of the shelf 10 is that it provides a person with the convenience of providing a storage place for the person's various items he or she may be carrying. The shelf 10 provides a safe, clean storage area which is out of reach of criminals and is off of the dirty floor. The shelf 10 provides multiple storage areas, such as the base 30 and the hooks 42.

Thus there has been shown and described a novel public rest room shelf which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A rest room shelf positioned within a rest room stall, comprising:

a base having a first and second side edge and a surface positioned therebetween, said surface formed of a grid for a person using a rest room to position items on said surface;

at least one hook attached to said base and hanging downwardly therefrom for enabling a person to hang items from said hook;

a pair of U-shaped brackets attached to each of said first and second side edges of said base, each of said U-shaped brackets having a first bracket member and a second bracket member slidably attached together, each of said first and second bracket members having a first arm extending vertically along a rest room stall wall, said first arm of said first bracket member positioned on an opposite side of the rest room stall wall as said first arm of said second bracket member, each of said first and second bracket members having a second arm extending substantially perpendicular to said first arm and having a slot therein, said second arm of said first bracket overlapping said second arm of said second bracket for forming said U-shaped brackets;

a fastener positioned within each of said slots of said second arms of said first and second bracket members for adjustably attaching said first and second bracket members together; and an adjustment member adjustably attached to at least one of said first arms of said U-shaped brackets and contacting said rest room stall wall for providing support to said rest room shelf.

2. The rest room shelf according to claim 1, wherein said fastener includes:

a screw disposed through said slots of said first and second bracket members for adjustably securing said U-shaped bracket to said rest room stall wall;

a nut threadedly attached to said screw; and a locking washer positioned between said nut and one of said first and second brackets.

3. The rest room shelf according to claim 1, wherein said first arm has a hole therethrough and said adjustment member further comprises:

a nut attached to said first arm of said U-shaped bracket;

a wing nut having a threaded rod extension disposed through said hole of said first arm and threadedly attached to said nut; and a cushioned tip attached to said threaded rod extension and contacting said rest room stall wall.

4. A rest room shelf positioned within a rest room stall, comprising:

a base having a first and second side edge and a surface positioned therebetween for a person using a rest room to position items on said surface;

at least one pair of first brackets having a U-shape and attached to at least one of said first and second side edges of said base, each of said first brackets having a first bracket member and a second bracket member slidably attached together, each of said first and second bracket members having a first arm positioned on opposite sides of a rest room stall wall and extending vertically along a rest room stall wall and a second arm extending substantially perpendicular to said first arm and having a slot therein, said second arm of said first bracket member overlapping said second arm of said second bracket member for forming said U-shape and for positioning said first brackets on said rest room stall wall;

a fastener positioned within said slots of said second arms of said first and second bracket members which are positioned aligned and overlapping for adjustably attaching said first and second bracket members together; and an adjustment member adjustable attached to at least one of said first arms and contacting said rest room stall wall for providing support to said rest room shelf.

5. The rest room shelf according to claim 4, further comprising a pair of second brackets attached to one of said first and second side edges of said base, each of said second brackets extending substantially vertically along a wall of the rest room and attached to the wall of the rest room.

6. The rest room shelf according to claim 5, further comprising:

said second bracket having at least one hole; and a securement member disposed through said hole of said second bracket and attached to said rest room wall.

7. The rest room shelf according to claim 4, further comprising at least one hook attached to said base and hanging downwardly therefrom for enabling a person to hang items from said hook.

8. The rest room shelf according to claim 4, wherein said base is formed of a grid.

9. The rest room shelf according to claim 4, wherein said fastener includes:

a screw disposed through said slots of said first and second bracket members for adjustably securing said U-shaped bracket to said rest room stall wall;

a nut threadedly attached to said screw; and a locking washer positioned between said nut and one of said first and second brackets.

10. The rest room shelf according to claim 4, wherein said first arm has a hole therethrough and said adjustment member further comprises:

a nut attached to said first arm of said U-shaped bracket;

a wing nut having a threaded rod extension disposed through said hole of said first arm and threadedly attached to said nut; and a cushioned tip attached to said threaded rod extension and contacting said rest room stall wall.

* * * * *